US007252056B2

(12) United States Patent
Payne et al.

(10) Patent No.: US 7,252,056 B2
(45) Date of Patent: Aug. 7, 2007

(54) TARGET WHEEL PRE-ASSEMBLY FOR A CAMSHAFT PHASER

(75) Inventors: Natalie G. Payne, Rochester, NY (US); Dominic Borraccia, Spencerport, NY (US); David M. McCarthy, Churchville, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/151,074

(22) Filed: Jun. 13, 2005

(65) Prior Publication Data

US 2006/0278188 A1 Dec. 14, 2006

(51) Int. Cl.
*F01L 1/34* (2006.01)

(52) U.S. Cl. ..... 123/90.15; 123/90.17; 123/90.31

(58) Field of Classification Search ..... 123/90.15, 123/90.16, 90.17, 90.31
See application file for complete search history.

(56) References Cited

U.S. PATENT DOCUMENTS 3,363,436 A * 1/1968 Krsto ..... 431/125
5,026,233 A * 6/1991 Carothers ..... 411/177
5,984,138 A * 11/1999 Olson ..... 220/801
6,318,319 B1 * 11/2001 Miyasaka et al. ..... 123/90.17
2001/0042528 A1 * 11/2001 Takahashi ..... 123/90.15

* cited by examiner

*Primary Examiner*—Thomas Denion
*Assistant Examiner*—Zelalem Eshete
(74) *Attorney, Agent, or Firm*—Paul L. Marshall

(57) ABSTRACT

A target wheel/rotor pre-assembly for a camshaft phaser. A phaser rotor includes a central bore. A target wheel axial extension having a plurality of barbs is entered into the bore to fix the target wheel to the rotor, both axially and rotationally, prior to assembly of the rotor into a phaser stator during manufacture of the phaser. Simple gauge blocks or a fixture can be used to index the target wheel to the rotor such that all such rotor/wheel subassemblies are substantially identical, to a high degree of precision. Alternatively, the axial extension may be formed without barbs, the extension inserted into the rotor bore, and then the extension immobilized as by stamping of the barbs, tack welding, or the like. For another example, the axial extension may be formed as a separate intermediate barbed retainer that engages both the rotor bore and the target wheel.

9 Claims, 4 Drawing Sheets

TARGET WHEEL PRE-ASSEMBLY FOR A CAMSHAFT PHASER

TECHNICAL FIELD

The present invention relates to camshaft phasers for internal combustion engines; more particularly, to target wheels for determining the angular status of a phaser rotor; and most particularly, to method and apparatus for fixing the axial and angular relationship of a target wheel to a rotor prior to installation of a phaser into an engine.

BACKGROUND OF THE INVENTION

Camshaft phasers for varying the timing of valves in internal combustion engines are well known. A typical phaser comprises a rotor, attached to a camshaft, and a stator surrounding the rotor and driven in time with an engine crankshaft. The phaser is able to vary the angular position of the rotor with respect to the stator and thus to vary the valve timing imposed on the camshaft with respect to the crankshaft and pistons.

A phaser may include an external timing wheel, having notches or other indicia, fixedly attached to the rotor such that the angular position of the rotor within the stator may be determined at any time by interrogating the target wheel. A prior art target wheel preferably is formed by stamping from sheet metal to minimize the mass and inertia of the wheel. In the prior art, the target wheel is indexed to the rotor during assembly of the phaser. However, it has been found that the tolerance stackup of the components is such that indexing by this method is insufficiently precise for maximizing engine control. What is need in the art is an improved method for indexing a timing wheel to a camshaft phaser rotor.

It is a principal object of the present invention to provide retention and to improve the indexing precision of a camshaft phaser timing wheel to a phaser rotor in order to improve performance of an engine to which the phaser is eventually mounted.

SUMMARY OF THE INVENTION

Briefly described, a camshaft phaser rotor includes a central bore for passage of a mounting bolt during attachment of an assembled camshaft phaser to an end of a camshaft. A target wheel barbed axial extension is entered into the bore, or into a counter bore disposed coaxially to the central bore, to fix the target wheel to the rotor, both axially and rotationally, prior to assembly of the rotor into a phaser stator during manufacture of the phaser. Simple gauge blocks or a fixture can be used to index the target wheel to the rotor such that all such rotor/wheel subassemblies are substantially identical, to a high degree of precision.

The wheel may be attached to the rotor by any of several alternative mounting elements. For example, the wheel may include an axial extension having barbs or other radially-displaced elements formed as by stamping in its outer surface, which barbs grip the rotor bore to immobilize the wheel in the correct position with respect to the rotor after the extension is pressed into the bore. For another example, the axial extension may be formed without barbs, the extension inserted into the rotor bore, and then the extension immobilized as by stamping of the barbs, tack welding, or the like. The barbs may also be die cut in the wall of the axial extension, and may be partially or not at all displaced outward. Then the extension can be immobilized in the rotor bore by displacing the barbs outward against the rotor bore with a tool once the wheel is properly oriented to the rotor. For yet another example, the axial extension may be formed as a separate intermediate barbed retainer that engages both the rotor bore and the target wheel.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
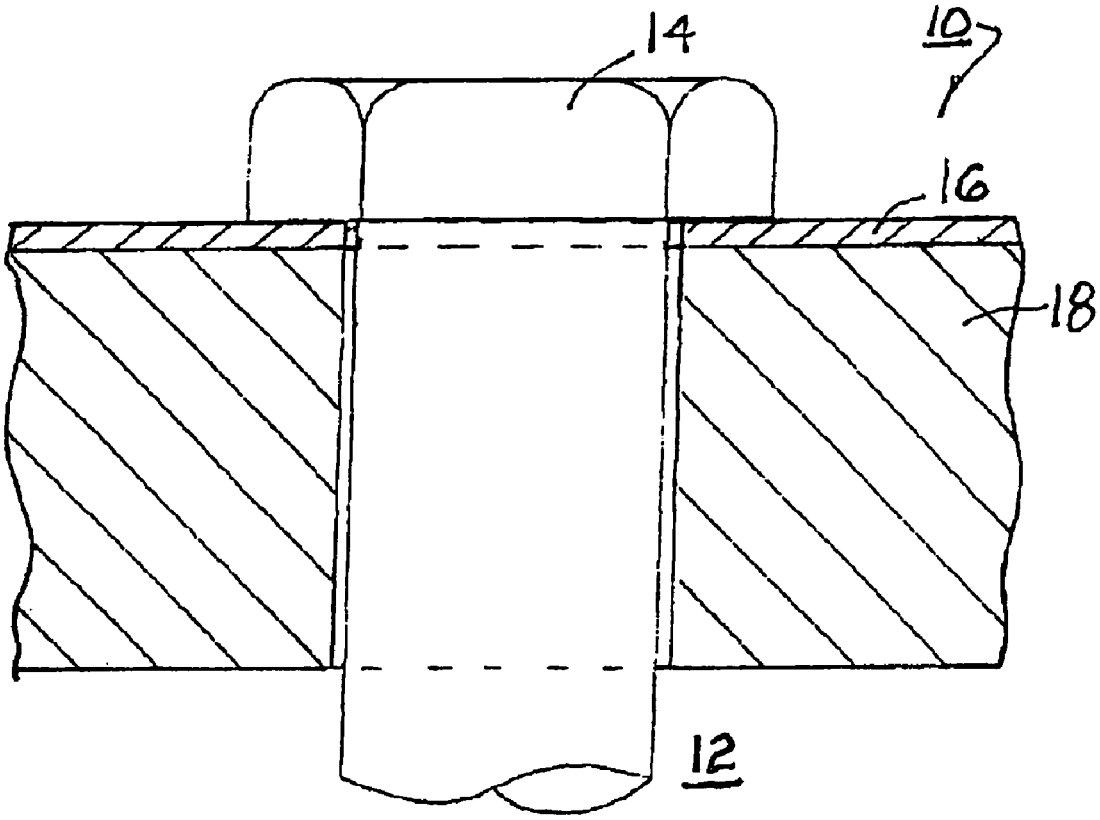
FIG. 1 (PRIOR ART)
FIG. 1 is a schematic elevational cross-sectional view of a portion of a prior art camshaft phaser assembly, showing a target wheel fixed against a rotor by a phaser mounting bolt.

Referring to FIG. 1, in a portion of a prior art camshaft phaser assembly 10 as mounted to an engine 12 by a mounting bolt 14, a target wheel 16 is in compressional contact with a phaser rotor 18. For simplicity in presentation, the target wheel is shown as lying against the rotor in schematic FIG. 1; however, as is well known to those of skill in the art of camshaft phasers, actual contact between the target wheel and rotor may take any of various forms not explicitly shown here, including having an axial protrusion of the target wheel extending through a cover plate between the target wheel and rotor and into a well in the rotor. All such known configurations are intended to be subsumed by schematic FIG. 1.

Figure 2:
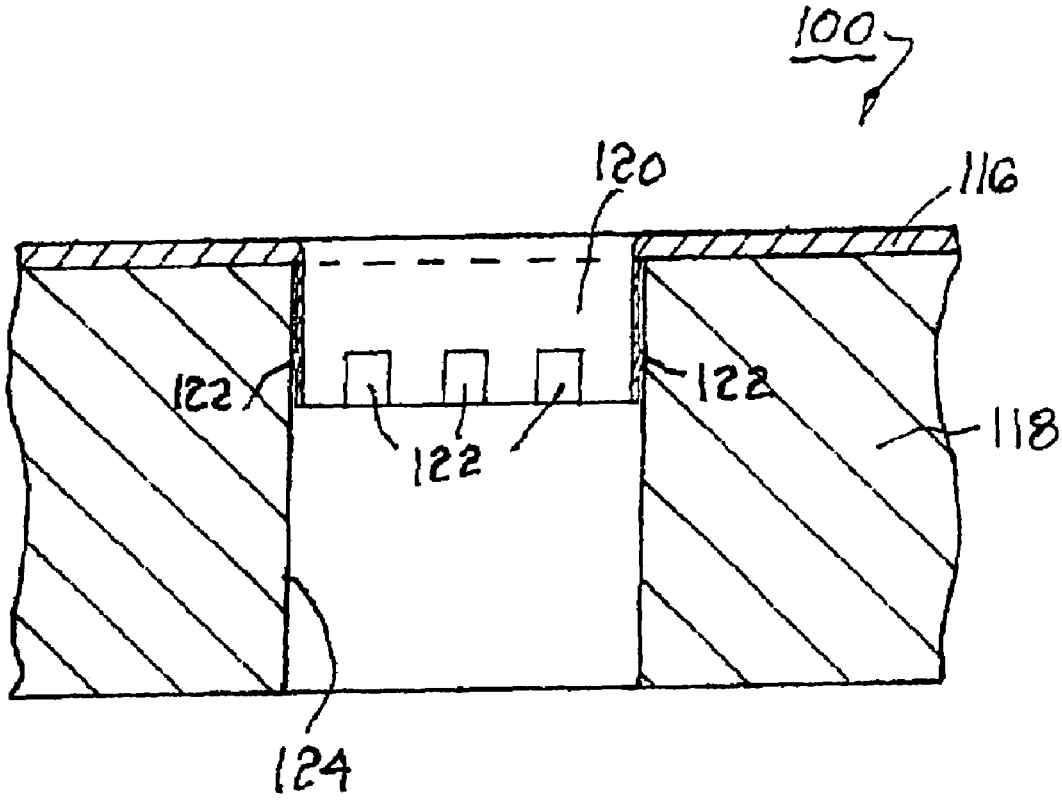
FIG. 2 is a schematic elevational cross-sectional view of a portion of a first embodiment of a camshaft phaser pre-assembly in accordance with the invention.

Referring to FIG. 2, in a pre-assembly 100 in accordance with the invention, target wheel 116 is provided with a tubular axial extension 120 comprising a plurality of barbs 122 formed by stamping. In a preferred embodiment, the barbs are oriented as shown in FIG. 2 to bite into the rotor bore if removal of the wheel from the bore is attempted. Of course, other orientations of the barbs are contemplated by the invention as well. As used herein, "barbs" should be understood to mean all similarly-functional radially-extending members intended for gripping a rotor bore to immobilize a target wheel with respect to the bore.

In a manufacturing step ahead of the final assembly of a camshaft phaser, wheel 116 is assembled to rotor 118 by a) angularly indexing the wheel to the rotor, preferably by use of a gauge, fixture, or the like (not shown), and b) pressing extension 120 into rotor bore 124 until wheel 116 is stopped by rotor 118, to form pre-assembly 100. Barbs 122 prevent wheel 116 from further motion, either rotational or radial, respective of rotor 118 during or after assembly of pre-assembly 100 into a camshaft phaser such as phaser assembly 10.

Barbs 122 may be formed in extension 120 either prior to or after insertion of extension 120 into bore 124. The barbs may also be die cut in the wall of the axial extension, and may be partially or not at all displaced outward. Then the extension can be immobilized in the rotor bore by displacing the barbs outward with a tool once the wheel is properly oriented to the rotor. Other means of attachment of extension 120 to rotor 118, for example, spot welding, are fully comprehended by the invention.

Figure 2A:
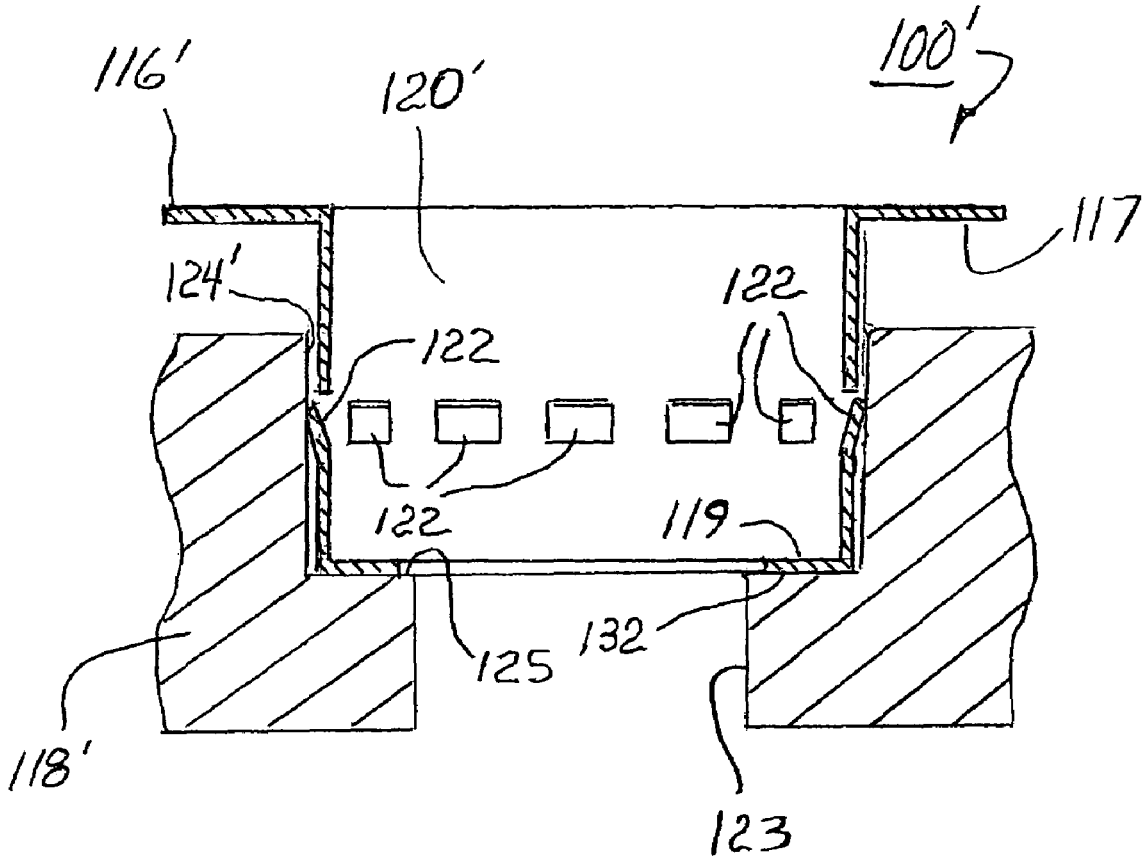
FIG. 2*a* is a schematic elevational cross-sectional view of a portion of a variation of the first embodiment in accordance with the invention.

Referring to FIG. 2*a*, a variation of the first embodiment, in accordance with the invention, is shown. In a pre-assembly 100', target wheel 116' is provided with upper flange 117 and tubular axial extension 120'. Wheel 116 is also provided with flange end 119 disposed distally from flange 117. Extension 120' comprises a plurality of barbs 122 formed by stamping. Rotor 118' includes bore 123 for receiving the mounting bolt, co-axial rotor counter bore 124', and ledge 125 disposed between the bores.

In a manufacturing step ahead of the final assembly of a camshaft phaser, wheel 116' is assembled to rotor by a) angularly indexing the wheel to the rotor, preferably by use of a gauge, fixture, or the like (not shown), and b) pressing extension 120' into rotor bore 124' until flange end 119 of wheel 116' is stopped by ledge 125 of rotor 118', to form pre-assembly 100'. Barbs 122 prevent wheel 116' from further motion, either rotational or radial, respective of rotor 118' during or after assembly of pre-assembly 100' into a camshaft phaser such as phaser assembly 10.

Barbs 122 of wheel 116' may be formed in extension 120' either prior to or after insertion of extension 120' into bore 124'. The barbs may also be die cut in the wall of the axial extension, and may be partially or not at all displaced outward. Then the extension can be immobilized in the rotor bore by displacing the barbs outward with a tool once the wheel is properly oriented to the rotor. Other means of attachment of extension 120' to rotor 118', for example, spot welding, are fully comprehended by the invention. In an alternate embodiment of FIG. 2*a*, radial nose portion 132 of wheel 116' may also includes a plurality of barbs similar to barbs 122, for engagement with ledge 125 to assist in keeping wheel 116' in it proper angular position relative to rotor 118' until subassembly 100' is assembled onto engine 12 by bolt 14.

Figure 3:
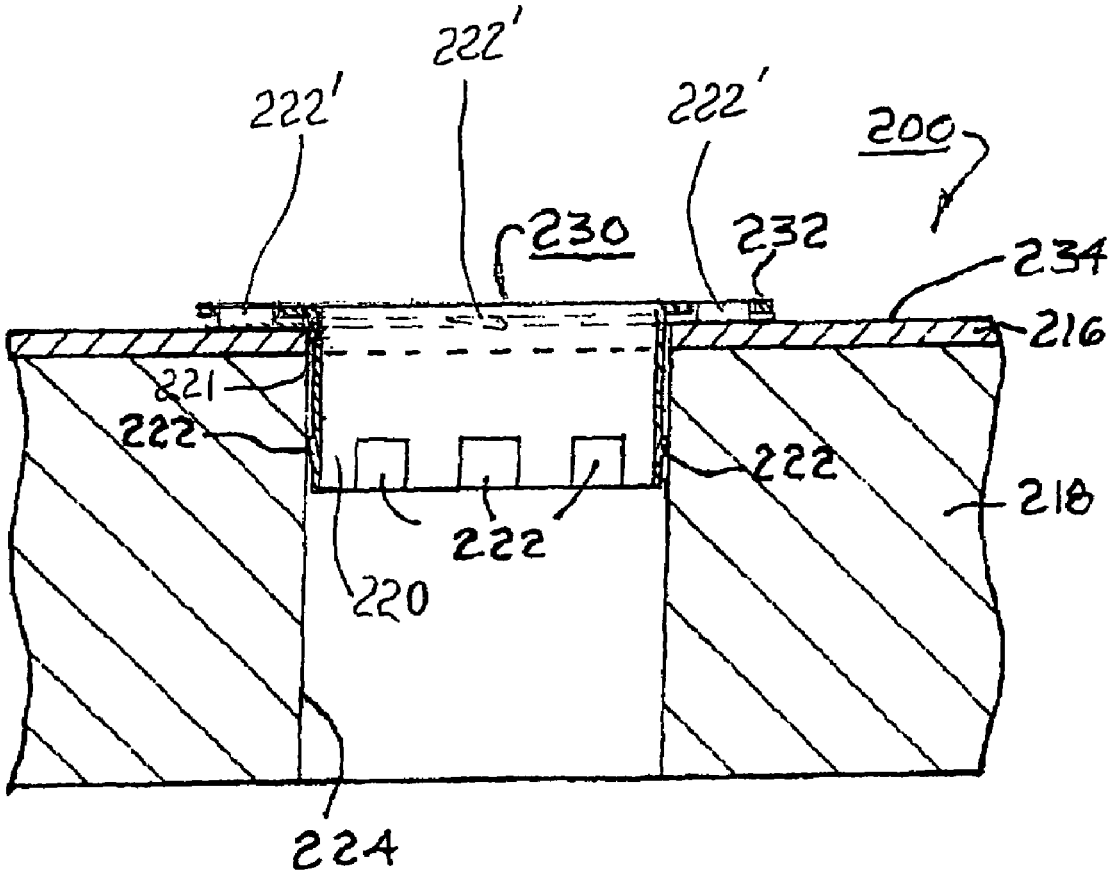
FIG. 3 is a schematic elevational cross-sectional view of a second embodiment of a camshaft phaser pre-assembly in accordance with the invention.

Referring to FIG. 3, a second embodiment 200 of a pre-assembly in accordance with the invention comprises a target wheel retainer 230 having an axial portion 220 similar to extension 120 and a radial portion 232 for engaging an outer surface 234 of target wheel 216. A plurality of barbs 222, similar to barbs 122, are formed in axial portion 220.

In a manufacturing step ahead of the final assembly of a camshaft phaser, wheel 216 is assembled to rotor 218 by a) angularly indexing the wheel to the rotor, as in 20 embodiment 100, and b) inserting axial portion 220 through a central opening 221 in wheel 216 and into rotor bore 224 until wheel 216 is stopped by rotor 218, to form pre-assembly 200. Axial compressive force exerted by retainer 230 on outer surface 234 of wheel 216 keeps wheel 216 in position relative to rotor 218 until subassembly 200 is assembled onto engine 12 by bolt 14. In a preferred embodiment, radial portion 232 of retainer 230 also includes a plurality of barbs 222', similar to barbs 222, for engaging outer surface 234 of target wheel 216 to assist in keeping wheel 216 in position relative to rotor 218 until subassembly 200 is assembled onto engine 12 by bolt 14.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A pre-assembly for a camshaft phaser for an internal combustion engine, said pre-assembly comprising:

a) a rotor having a central bore; and b) a target wheel having an axial extension extending into said central bore, wherein said axial extension includes a plurality of barbs circumferentially spaced about the axial extension and extending radially therefrom to engage said central bore.

2. A pre-assembly in accordance with claim 1 wherein said barbs are formed in said axial extension before insertion thereof into said central bore.

3. A pre-assembly in accordance with claim 1 wherein said barbs are formed in said axial extension after insertion thereof into said central bore.

4. A pre-assembly for a camshaft phaser for an internal combustion engine, said pre-assembly comprising:

a) a rotor having a central bore;

b) a target wheel having a central opening; and c)

a target wheel retainer extending through said target wheel central opening and into said central bore, wherein said target wheel retainer includes a plurality of barbs circumferentially spaced about the target wheel retainer and extending radially therefrom to engage said central bore.

5. A camshaft phaser comprising a pre-assembly, said pre-assembly including, a rotor having a central bore, and a target wheel having an axial extension extending into said central bore, wherein said axial extension includes a plurality of barbs circumferentially spaced about the axial extension and extending radially therefrom to engage said central bore.

6. A camshaft phaser comprising a pre-assembly, said pre-assembly including, a rotor having a central bore, a target wheel having a central opening, and a target wheel retainer extending through said central opening and into said central bore, wherein said target wheel retainer includes a plurality of barbs circumferentially spaced about the target wheel retainer and extending radially therefrom to engage said central bore.

7. A camshaft phaser in accordance with claim 6 wherein said retainer includes a radial portion having at least one barb extending axially therefrom to engage said target wheel.

8. A method for fixing a target wheel to a rotor in a camshaft phaser, comprising the steps of:

a) providing an axial bore in said rotor in said camshaft phaser;

b) providing a barbed axial extension on said target wheel, said barbed axial extension including barbs that are circumferentially spaced about the axial extension and extend radially outward; and c) pressing said barbed axial extension into said axial bore to engage said barbs with said rotor.

9. A method in accordance with claim 8 comprising the further step of angularly indexing said target wheel to said rotor prior to said pressing step.

* * * * *